US010335337B2

(12) United States Patent
Gay et al.

(10) Patent No.: US 10,335,337 B2
(45) Date of Patent: Jul. 2, 2019

(54) INCUBATOR WITH THERMOREGULATING ARRANGEMENT FOR NEWBORNS SUFFERING FROM PATHOLOGIES

(71) Applicants: Eduardo Alfonso Gay; Carlos Alberto Bonetto; Gerardo Peman

(72) Inventors: Eduardo Alfonso Gay, Ciudad de Santa Fe (AR); Carlos Alberto Bonetto, Ciudad de Santa Fe (AR)

( * ) Notice: Subject to any disclaimer, the term of this patent is extended or adjusted under 35 U.S.C. 154(b) by 0 days.

(21) Appl. No.: 15/510,058

(22) PCT Filed: May 20, 2015

(86) PCT No.: PCT/CL2015/050014

§ 371 (c)(1),
(2) Date: Mar. 9, 2017

(87) PCT Pub. No.: WO2015/176193

PCT Pub. Date: Nov. 26, 2015

(65) Prior Publication Data

US 2018/0168902 A1 Jun. 21, 2018

(30) Foreign Application Priority Data

May 23, 2014 (AR) ..... 20140102037

(51) Int. Cl.
*A61G 11/00* (2006.01)
*A61G 10/02* (2006.01)
*A61G 10/00* (2006.01)
*A61G 10/04* (2006.01)

(52) U.S. Cl.
CPC ..... *A61G 11/006* (2013.01); *A61G 10/00* (2013.01); *A61G 10/02* (2013.01); *A61G 10/04* (2013.01); *A61G 11/00* (2013.01)

(58) Field of Classification Search
CPC ..... A61G 11/00; A61G 11/001–009
See application file for complete search history.

(56) References Cited

U.S. PATENT DOCUMENTS

| | | | | |
|---|---|---|---|---|
| 3,818,896 A * | 6/1974 | Deaton | A61G 10/04 600/22 |
| 4,936,824 A * | 6/1990 | Koch | A61G 11/00 128/205.26 |
| 2001/0016677 A1* | 8/2001 | Poole | A61G 11/00 600/22 |
| 2011/0172487 A1* | 7/2011 | Khodak | A61G 11/00 600/22 |

* cited by examiner

*Primary Examiner* — Carrie R Dorna
(74) *Attorney, Agent, or Firm* — Eugenio J. Torres-Oyola; Victor M. Rodriguez-Reyes; Rafael Rodriguez-Muriel

(57) ABSTRACT

The invention relates to an incubator with a thermoregulating arrangement for newborns suffering from pathologies, comprising a closed compartment consisting of a horizontal partition that separates an upper part from a lower part, wherein the upper part has receiving and housing elements for the newborn, while the lower part has respective means and elements for thermoregulation, measurement, etc., which allow the production of air flows that maintain environmental conditions according to the newborn's needs.

4 Claims, 3 Drawing Sheets

INCUBATOR WITH THERMOREGULATING ARRANGEMENT FOR NEWBORNS SUFFERING FROM PATHOLOGIES

STATE OF THE ART OF THE INVENTION

Field of the Invention

The present invention relates to the field of equipment, means and arrangements employed for newborns, preferably for pathological ones, and more particularly it relates to a non-invasive thermoregulating medical device for a pathological newborn which, unlike conventional incubators, allows the regulation of temperature within the environment in which the pathological newborn is found without the need to use equipment, instruments or external means.

While mention is made of an incubator throughout the present description, it should be understood that it is a novel non-invasive and thermoregulatory sanitary product which can either lower the temperature to the newborn or raise it. This clarification is made because the term incubator associated with popular usage and custom, is understood as a heating or brooding element.

Description of the Prior Art

In order to better understand the object and scope of the present invention it is convenient to describe the current state of the art in reference to pathological newborns and the disadvantages that arise during the preventive care thereof.

Pathological newborns need a range of special care from birth and during their stay in the observation unit or neonatal intensive care unit. This is because they are very likely to have sequelae that are difficult to treat, such as blindness, deafness and cerebral palsy, which in many cases are prevented with adequate follow-up. To do this, parameters such as heart and respiratory rate, temperature, pulse oximetry, blood glucose and serum calcium levels should be controlled in the Monitoring Unit, among other important parameters. However, despite the greater internal efficiency of hospitals in their neonatal intensive care units, there is a lack of external efficiency due to the lack of follow-up networks that involve all levels of health care, either from care Primary level in the first level to reach the centres of high complexity to solve the most serious problems. This situation is responsible for the death of many children at risk.

Currently, one of the devices that are used for the treatment of pathological newborns, hereinafter pathological NB, is the incubator. Such incubator works as an artificial uterus that recreates an optimal environment for the newborn, being a closed space well insulated thanks to the air filters that are in the ducts to the outside. These filters are able to retain dust and allergens present in the environment, but also prevent bacteria or germs from coming into contact with the newborn. On the other hand, in order to control hydration, not only the temperature of the environment is important, but so is the degree of humidity, since a very dry environment favours dehydration even at low temperatures. The incubator has sensors that when they detect a sensible decrease of the relative humidity, they cause that the humidifiers of the environment are activated. In addition, the incubator can present an electronic balance that keeps a continuous record of the NB's weight. Thanks to the provision of the balance, you can keep a record of the evolution of the NB without having to move it to other sectors for their respective analysis.

On the other hand, the newborn has on its body surface several electrodes capable of recording the basic vital functions. These sensors include an electrocardiogram that records the heart rate, an electroencephalogram that records brain activity, and respiratory rate sensors. All of them are adapted to both premature and non-premature babies.

In summary, one of the most important reasons the incubator is used is the difficulty of many newborns, especially premature or underweight, to maintain their body temperature at 36-37° C., naturally. The incubator allows them to maintain a suitable temperature until they themselves are able to maintain it without difficulty. In cases where a term NB must be cooled with Ischemic Intrapartum Hypoxia "IH", ice or water at 10° C. are used in contact and conduction bags, which lower the temperature of the NB, thus preventing death or brain damage. Although the use of the incubator has helped to keep NBs in stable environmental conditions, there are still a number of drawbacks to maintaining temperatures suitable for certain pathologies. Likewise, the use of external equipment or means to cool the NB many times makes difficult the work of the specialist who must treat the NB.

In virtue of the current state of the art available for pathological newborns, it will be very convenient to have a new thermoregulating apparatus which is constituted and constructed to solve the aforementioned drawbacks and, in addition, to allow better environmental conditions for newborns without the need to resort to external equipment or resources.

BRIEF DESCRIPTION OF THE INVENTION

It is therefore an object of the present invention to provide a non-invasive, thermoregulating medical product which provides better environmental conditions therein so that pathological newborns can be stable and safe.

It is yet another object of the present invention to provide a thermoregulating means or arrangement within the environment which allows both heating and cooling thereof.

It is still another object of the present invention to provide an incubator which does not use external means to cool pathological NB.

It is yet another object of the present invention to provide at least one hot or cold air circulation flow which envelops the NB within a bubble without the air flow coming into contact with the NB.

It is a further object of the present invention to provide at least two air circulation flow that regulate the proper temperature within the environment and further allow visibility towards the interior of the incubator.

It is another object of the present invention to provide an incubator which, unlike conventional incubators which only heat the environment, allows for cooling of the compartment thanks to the arrangement of a thermoregulating element.

It is yet another object of the present invention to provide an incubator with a thermoregulating arrangement for newborns suffering from pathologies, comprising a closed compartment which externally has a plurality of openings and an access door, while internally it is comprised of a horizontal partition defining an upper part where the newborn is resting and a lower part provided with measuring elements and thermoregulating means that produce air flows, that maintain the newborn at required temperatures, wherein said upper part comprises an outer hood separated from an inner hood, an upper external circulation channel being defined therebetween, said partition is provided with end communication holes which communicate with each other to the upper part and the lower part, said lower part has a pair of lateral holes which are in connection with said upper external circulation channel through respective lower external circulation channels, and at least one thermoregulating element is provided in said lower part.

BRIEF DESCRIPTION OF THE DRAWINGS

For the sake of clarity and understanding of the object of the present invention, it has been illustrated in several figures, in which the invention has been represented in one of the preferred embodiments, all by way of example, in which.

DETAILED DESCRIPTION OF THE INVENTION

Referring now to the figures, it is seen that the invention consists of a new incubator or a non-invasive medical product with thermoregulating arrangement for pathological newborn. The incubator allows newborns to be at ideal temperatures so that they are not injured or physically damaged. Likewise, the incubator of the present invention regulates, in a practical and rapid manner, the temperature inside the compartment by means of hot or cold air flows, depending on the situation in which the newborn is, without the need for external equipment or means.

Figure 1:
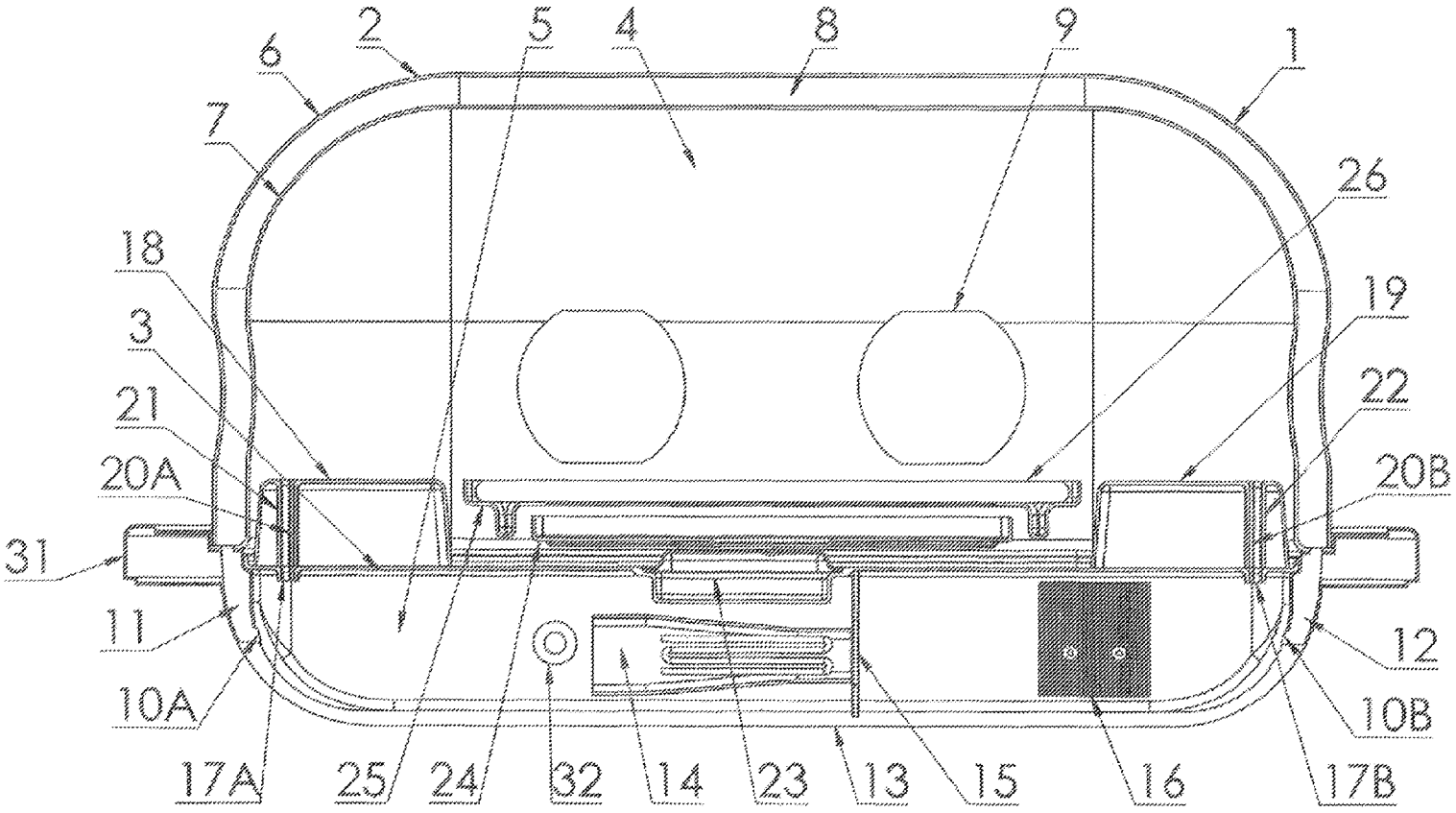
FIG. 1 shows a side cross-sectional view of the incubator according to the present invention.
Figure 2:
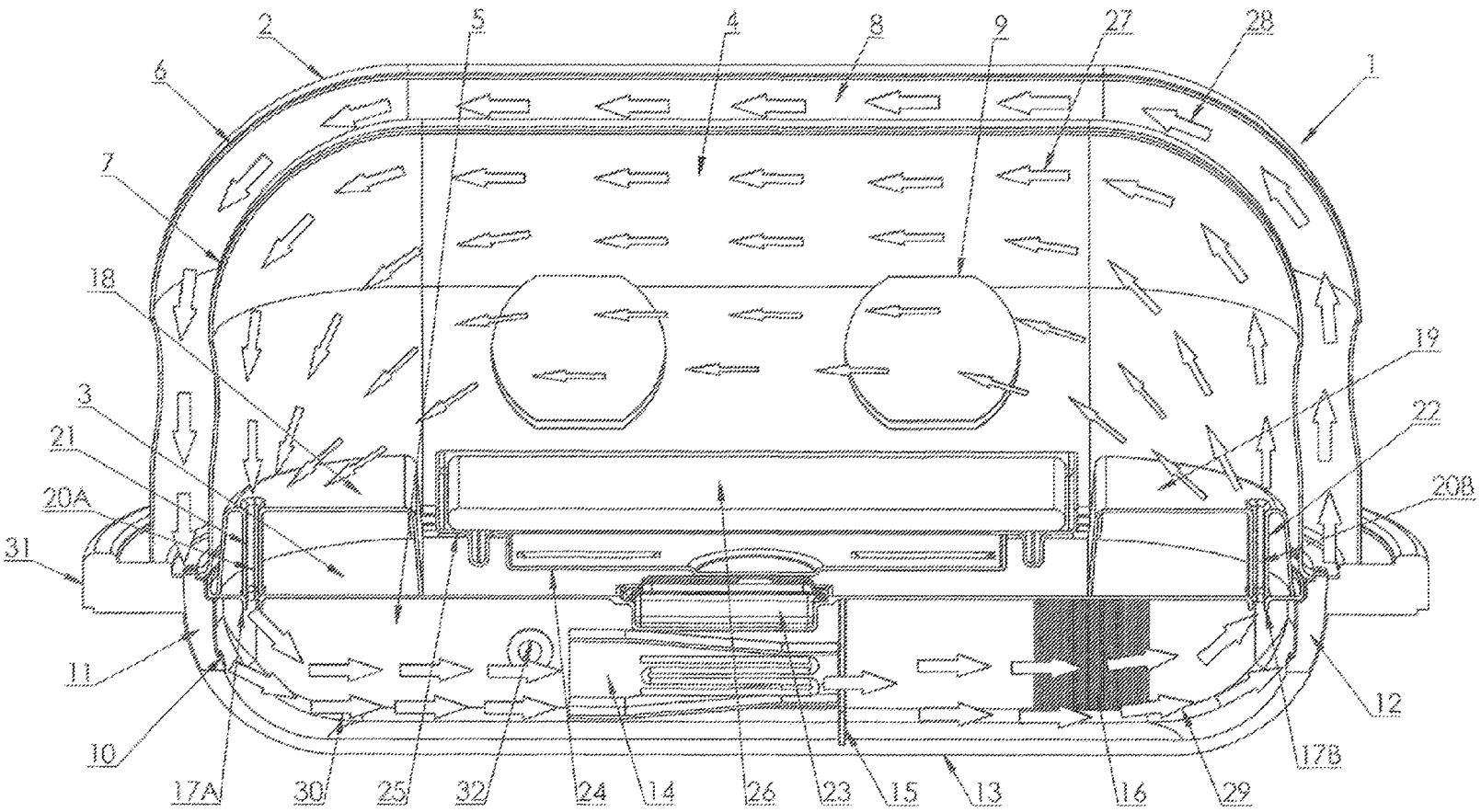
FIG. 2 shows another side cross-sectional view of the incubator, in which the direction of circulation of airflows within the incubator can be seen.
Figure 3:
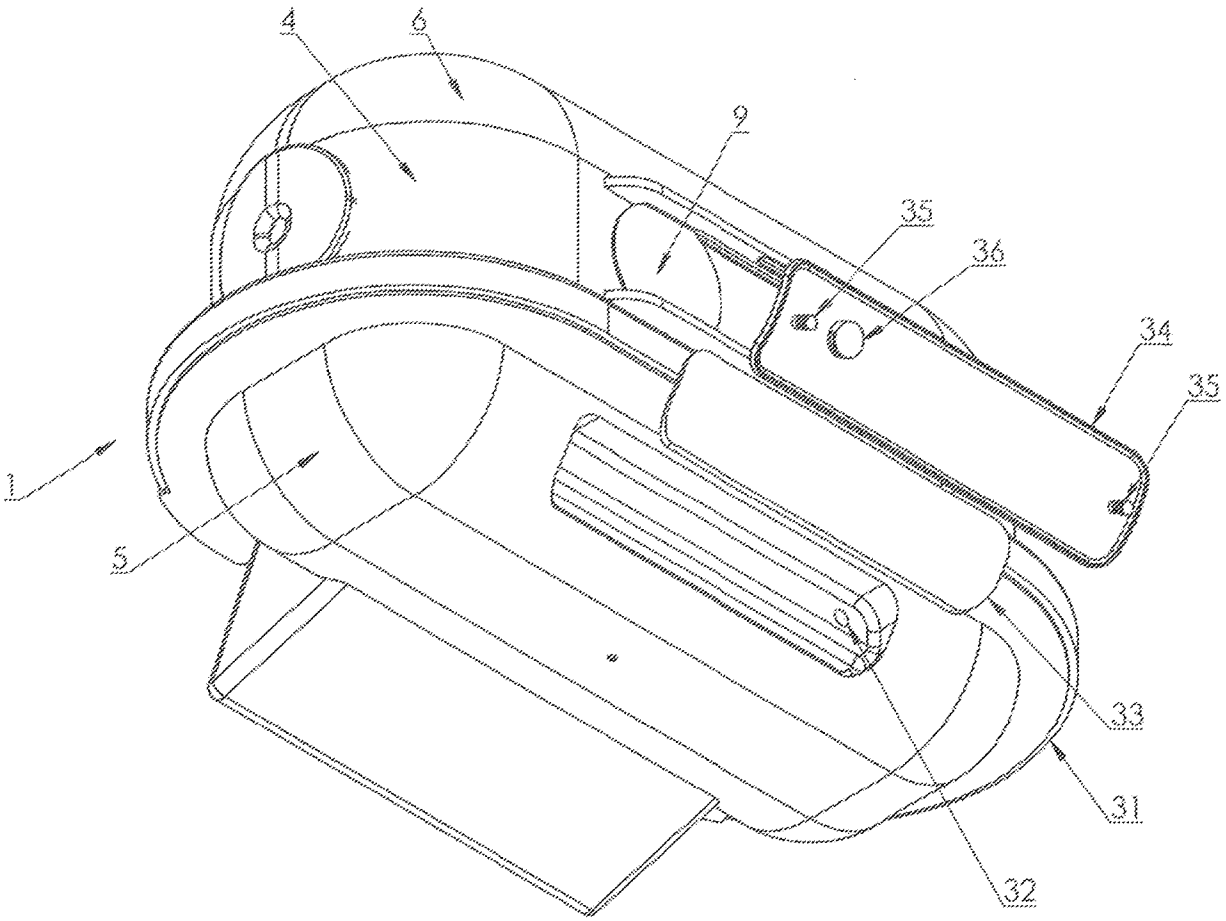
FIG. 3 shows a perspective view taken from below of the incubator according to the present invention.

According to FIGS. 1 to 3, the incubator of the present invention is indicated by the general reference 1 and comprises a closed compartment 2 which internally has a horizontal partition 3 which separates the compartment 2 in an upper part 4 and a lower part 5. Where, said upper part 4 is comprised of an outer hood 6 which is separated from an inner hood 7, the separation distance of which forms an upper external circulation channel 8. Said outer hood 6 and said inner hood 7 are curved, hemispherical and transparent to allow the visibility into the interior of the compartment 2 and are provided with a plurality of access openings 9 which assist the skilled personnel so that they can carry out their function without any inconvenience.

Moreover, said lower part 5 of the compartment 2 is opaque and has a pair of lateral holes 10 communicating with said upper external circulation channel 8 by respective lower external circulation channels comprising a low pressure lower external circulation channel 11 and a high pressure lower external circulation channel 12. Likewise, said lower part 5 has, in an middle portion of its path, at least one thermoregulating means 13 comprising at least one heating resistor 14 in conjunction with a baffle 15 which is disposed continuously and adjacent to it. A thermoregulating element 16 which may be a peltier module 16, is mounted on the lower part 5 of the compartment 2 through respective slides and following the deflector 15, that is, is disposed to the right of the deflector 15 as may be seen in FIGS. 1 and 2. Said peltier module 16 comprises a funnel-shaped aluminium body with rectangular section, which acts interrelated with its dual cold/heat function and the resistance 14, thus providing a slow or rapid response to the demands of times to provide temperatures to the newborn. For the circulation of the generated temperatures, a variable speed motor (not shown) is established at the rear of said peltier module 16, which establishes the forced circulation air flow, with variable speed automatically according to requirements.

The peltier module 16 generates both hot air flows and cold air flows, depending on the needs and pathologies of each newborn. It is noted that both the heating resistor 14 and the peltier module 16 are connected to a power source and are manipulated by respective electronic/electromechanical mechanisms or means, which are well known in the field of art and which for that reason are not illustrated in the present FIGS. 1 and 2, nor will they be described in detail.

Referring again to the horizontal partition 3, it is provided with communication end ports 17 which communicate with each other to the upper part 4 and the lower part 5. Likewise, said partition 3 is provided with a first head 18 and a second head 19, each of which has at least one communication line 20 which is connected to its respective end port 17. Wherein, said communication line 20 *a* of the first head 18 in conjunction with its respective end communication port 17 *a*, defines a low pressure internal air channel 21, whereas, said communication line 20 *b* of the second head 19 in conjunction with its respective end communication port 17 *b*, define a high pressure internal air channel 22. In addition, said partition 3 has, in a middle portion of its path, at least one receptacle 23 on which a measuring element (not shown) is arranged, being arranged above which said receptacle 23, at least one lower mattress tray 24 which is housed beneath an upper mattress tray 25 which is provided with a resting means 26 which can be a mattress. In this way, the upper part 4 is in communication with the lower part 5 through said low 21 and high pressure 22 internal air channels 22, and of said low 11 and high pressure 12 lower external circulation channels. Likewise, there is provided a support body 31 which is parallel to the partition 3 and arranged on the outside of said compartment 2, said body 31 being operable to manipulate the incubator 1 in a practical manner. Said support body 31 surrounds the exterior of compartment 2 in a middle part thereof, and receives said outer hood 6.

It is noted that the incubator of the present invention may be provided with an indicator reader (not shown) of the various functions performed as well as a support arrangement (not shown) together with drawers for choosing the height of work to realize different functions of adjustment, they being support of several constituent elements. Likewise, the upper part 4 may be provided with an access door (not shown) which allows the entry/exit of the newborn in/from the incubator. In turn, the incubator of the present invention may have an adjustable inlet window (not shown) for the intake of air from the outside, which is disposed at the end of a cover (not shown) where there is a filter element (not shown) that allows the passage of air by trapping, in turn, those microscopic particles with a large surface to thus optimize the conditions of air filtration.

According to FIG. 2, it can be seen that an upper internal air flow 27, an upper external air flow 28, a lower outgoing air flow 29 and a lower incoming air flow 30 are defined. The air circulation cycle begins at the lower part 5 of the compartment 2 from the baffle 15 in conjunction with the peltier module 16, which generate said lower outgoing air flow 29 at high pressure which is divided and enters simultaneously by the lateral hole 10 *b* and by the end hole 17 *b*. Once entered by the lateral hole 10 *b*, the air flow follows its path through the high pressure internal air channel 22 and enters inside the upper part 4 of the compartment 2, said upper internal air flow 27 being generated, which divides and circulates as indicated by arrows in FIG. 2, to then enter by the low pressure internal air channel 21 and out through the end hole 17 *a* to the lower part 5 of compartment 2. During the circulation underneath and concentrically to the inner hood 7, the air flows 27 do not collide with each other and possible turbulences are thus avoided, which may generate winds coming into contact with the NB. Simultaneously, once entered by the hole 10 *b*, the air flow follows its path through the high pressure lower external circulation channel 12 and enters the upper external circulation channel 8 defining said upper external air flow 28 which flows along thereof, until it enters the low pressure lower circulation channel 11 and exits through the lateral hole 10 *a* towards the lower part 5, in mixing with the air flow coming from the end hole 17 *a* and jointly defining said lower incoming air flow 30 passing through the heating resistor 14, the peltier 16 and the baffle 15, to start again with the circulation cycle.

It is emphasized that said upper internal air flow 27 maintains the temperature of the newborn in the ideal range, either by increasing or decreasing body temperature, whereas, said upper external air flow 28 prevents the fogging of the outer 6 and interior 7 hoods, and in turn, performs the function of isolating the interior of the upper part 4 to dissipate the temperatures. Likewise, it is important to emphasize the communication through a conduit 32 from the outside towards the low pressure zone, which allows the renewal, previously filtered by a filter 33, of 25% of the circulating air. The conduit 32 is in communication with the lower part 5 and prior to the resistance 14, that is, to the left thereof, as can be seen in FIGS. 1 and 2. Likewise, said filter 33 is housed between said conduit 32 and a rear cover 34 having a pair of threaded knobs 35 and an air inlet 36. In this way, the incubator of the present invention is formed and constructed, which provides the appropriate temperature with an extended range, with parameters which allow for regulating the core temperature of the newborn at will, being by way of example but not limiting for the invention, of a range of 30° C. to 36.7° C. Likewise, the incubator of the invention stands out above the conventional incubators, since it has a unique structure that allows it an optimum distribution of temperatures, giving the newborn, on the one hand, the normal neutral temperature, that is, the normal temperature range that a premature newborn with non-cerebral pathology requires, where its core temperature is in its normal range and without additional energy expenditure, and on the other hand, in the ischemic hypoxia it cools it. That is, the incubator of the invention provides a neutral thermal environment and, in turn, provides low temperatures to cool the newborn which requires the lowering of its core temperature for the preservation of its vital organs such as the brain. That is, unlike conventional incubators which only heat the environment, the incubator of the present invention allows cooling the environment thanks to the arrangement of the peltier 16.

On the other hand, there is the particularity that the upper part 4 has a double outer 6 and inner 7, hood, which define a space or upper external circulation channel 8 which is maintained along the entire transparent portion of the hoods, which have a continuous and curved surface. This feature makes it possible to generate the air flows 27 that circulate in a direction that avoids the generation of turbulence, since air shocks are completely eliminated, leaving a space where the newborn is in which there is air but not wind, that is, a bubble is formed. Simultaneously, the air flow 28 following a path through the channel 8, generates a thermal barrier which eliminates any possibility of influence of the outside temperature. Such two constructive characteristics combined, which define the double hood, are the basis and allow for adopting an air circulation arrangement that assures the newborn a temperature and humidity in accordance with the strict requirements requested, eliminating undesirable temperature ranges.

In summary, the novel functionality of the present invention avoids internal turbulence in the air circulation and completely eliminates the distortion of the inner vision from any viewing angle, in addition to the fact that the newborn receives windless air with controlled temperature and humidity thanks to the arrangement of the heating medium in conjunction with the cooling peltier module, so that it does not consume extra energy, the latter generated due to the air flows concentrically below the inner hood, to a height where the newborn is, leaving the NB in an air bubble, suitable to the requirements. Likewise, the visibility of the upper part of the compartment from the outside is emphasized since these hoods are made of bioacrylic and have a space distribution that does not distort the visibility of the child from any angle of vision.

The invention claimed is:

1. An incubator with a thermoregulating arrangement for newborns suffering from pathologies, comprising a closed compartment which externally has a plurality of openings and an access door, while internally it is comprised of a horizontal partition defining an upper part adapted to receive a newborn in a resting position and a lower part provided with thermoregulating means that produce air flows, adapted to maintain the newborn at required temperatures, said upper part comprises an outer hood separated from an inner hood with an upper external circulation channel being defined therebetween, wherein the upper external circulation channel being in fluid communication with said lower part through a low pressure lower external circulation channel and a high pressure lower external circulation channel, the thermoregulating means comprise a heating resistor, a baffle and a cold/heat generator, said partition is provided with a first head and a second head and at least one mattress tray between both heads, the first head includes a low pressure internal air channel and the second head includes a high pressure internal air channel, with the low pressure internal air channel and the high pressure internal air channel being arranged at opposite sides of the at least one mattress tray and the thermoregulating means and in fluid communication with opposite ends of the upper part defining an internal air flow flowing from said high pressure internal air channel towards the low pressure internal air channel and extending underneath and concentrically to the inner hood and spaced apart from the at least one mattress tray, thus forming a bubble around the at least one mattress tray.

2. An incubator according to claim 1, characterised in that said outer and inner hoods are transparent.

3. An incubator according to claim 1 or 2, characterised in that said partition further comprises, in a middle portion of its path, at least one receptacle, and said at least one mattress tray comprises at least a lower mattress tray which is housed beneath an upper mattress tray which is provided with resting means.

4. An incubator according to claim 1, characterised in that said cold/heat generator is Peltier plate and the baffle is located between the heating resistor and the Peltier plate, all located in a middle part of the lower part of the compartment.

* * * * *